US005403211A

United States Patent [19]

Sayer et al.

[11] Patent Number: 5,403,211

[45] Date of Patent: Apr. 4, 1995

[54] MULTI-CONDUCTOR TERMINAL ASSEMBLY

[75] Inventors: Christopher N. F. Sayer, Ferndale; David Shawcross, Heathridge, both of Australia

[73] Assignee: Orbital Engine Company (Australia) Pty, Limited, Balcatta, Australia

[21] Appl. No.: 41,980

[22] Filed: Apr. 2, 1993

[30] Foreign Application Priority Data

Apr. 2, 1992 [AU] Australia ..... PL1697

[51] Int. Cl.[6] ..... H01R 13/514

[52] U.S. Cl. ..... 439/752; 439/603

[58] Field of Search ..... 439/595, 752, 603

[56] References Cited

U.S. PATENT DOCUMENTS

| | | | |
|---|---|---|---|
| 3,573,720 | 4/1971 | Reynolds | 439/75 X |
| 3,880,490 | 4/1975 | Belmont . | |
| 4,277,124 | 7/1981 | Loose et al. . | |
| 4,867,711 | 9/1989 | Yuasa | 439/752 |

FOREIGN PATENT DOCUMENTS

| | | | |
|---|---|---|---|
| 62843/73 | 7/1976 | Australia . | |
| 91080 | 10/1983 | European Pat. Off. . | |
| 96961 | 12/1983 | European Pat. Off. . | |
| 0177810 | 4/1986 | European Pat. Off. | 439/603 |
| 496765 | 12/1938 | United Kingdom | 439/752 |
| 1097280 | 1/1968 | United Kingdom . | |
| 2122036A | 4/1984 | United Kingdom . | |
| 2197548 | 5/1988 | United Kingdom . | |

OTHER PUBLICATIONS

Patent Abstract of Japan, vol. 13, No. 404 (E=817) p. 139, JP 01-146272 (Matsushita Electric Ind Co Ltd.), published Jun. 8, 1989.

*Primary Examiner*—Eugene F. Desmond

*Attorney, Agent, or Firm*—Nikaido, Marmelstein, Murray & Oram

[57] ABSTRACT

A terminal assembly for a cable having a multiplicity of conductors, particularly having a relatively high number of small gauge conductors, and providing an individual terminal for each conductor.

The terminal assembly comprises a terminal block having a plurality of terminal cavities at one face of the block to receive respective terminal elements and a plurality of conductor apertures in the opposite end of the terminal block. The respective conductors with or without a terminal element connected thereto pass through each conductor aperture to be connected to a terminal element in, or to be located in, a respective terminal cavity. Locking means are provided of the terminal block adapted to anchor each conductor to the terminal block to thereby limit the transmission of cable or conductor movement externally of the terminal block to the terminal elements. The locking means includes an element selectively movable between a first position permitting passage of the conductors with or without a terminal element connected thereto through the conductor apertures into the terminal block and a second position locking each of the conductors relative to the terminal block.

13 Claims, 7 Drawing Sheets

MULTI-CONDUCTOR TERMINAL ASSEMBLY

Terminal assemblies for cables having a multiplicity of conductors are widely used, particularly in connection with electronic equipment where a relatively high number of small gauge conductors are normally incorporated in a single cable and require a terminal assembly which provides an individual terminal for each conductor.

Frequently, multi-conductors associated with a terminal assembly are required to operate in environments where various forms of vibrations and other movements are imparted to the conductors and/or terminal assembly, and give rise to defective performance of the terminals. In particular, it has been found that ineffective electrical contact between respective terminal elements of two inter-engaging terminal assemblies can arise due to vibration. The loss of contact arising from such vibrations is not permanent, but in electronic equipment, such loss of contact for periods measured in microseconds can lead to defective operation of the electronic equipment.

This problem is not well addressed by the prior art. A simple means of arresting such vibration might appear to be clamping the conductors into position as suggested by Australian Patent No. 474970 and U.S. Pat. No. 3,880,490. Both of these proposals suffer from the disadvantages that the conductors are not individually anchored into positions aligned with terminal elements and the degree of anchoring will vary from one conductor to another. Thus these proposals do not effectively address the vibration problems and, in fact, may place a strain on the conductors at a location remote to the terminal block. This is undesirable.

Other devices allowing individual anchoring of conductors, such as that disclosed in British Patent No. 1097280 and Japanese Patent Abstract No. 1146272 cause distortion of the conductors and a failure of the conductors to substantially align with the terminal elements. This is undesirable for the reason alluded to hereabove. Further, the rotary action of the clamping member in the British Patent results in the outer conductors being subject to a greater force than the inner conductors.

Proposals avoiding such strain on the conductors, such as those devices disclosed in British Patent Application No. 2197548 and U.S. Pat. No. 4,277,124, are equally not desirable because they do not allow ready disconnection of the conductors from the terminal elements because once the device is secured in the locking position, it is not possible to selectively move the device between an open and locked position. Further, the conductors must be located in position individually, and is thus time consuming.

It is therefore the object of the present invention to provide a terminal assembly for use with a multi-conductor cable that avoids the above-mentioned disadvantages and that will reduce the adverse effects of vibration in the cable or individual conductors of the cable and, thereby, provide a more effective and reliable contact between inter-engaging terminals.

With this object in view, there is provided according to the present invention a multi-conductor terminal assembly comprising a terminal block having a plurality of terminal cavities at one face of the block to receive respective terminal elements and a plurality of conductor apertures in another face of the terminal block arranged to permit respective conductors passing therethrough to be connected to a terminal element in, or to be located in, a respective terminal cavity, characterised by an anchor means adapted to be operable to individually anchor each conductor to the terminal block, said anchor means including a locking element selectively movable between a first position permitting passage of the conductors through the conductor apertures, and a second position locking each of said conductors relative to the terminal block, the respective conductors being substantially in alignment with said respective terminal cavities when said locking element is in said second position.

Preferably, each of said conductors is locked relative to the terminal block at a location adjacent the conductor apertures, through which the conductors enter the terminal block.

Conveniently, the anchor means is mounted either at one end of the terminal block or centrally thereof.

More specifically, the locking element comprises a lock member having a plurality of lock apertures therein corresponding in number and formation to the conductor apertures in the terminal block. The lock member is preferably mounted in the terminal block for movement relative thereto in a direction inclined, preferably transverse to the conductors extending through the conductor apertures. The lock member may be selectively movable between a receiver position wherein main circular portions of each of the lock apertures are substantially aligned with the conductor apertures in the terminal block, to permit the conductors to be passed through both, sets of apertures and a retention position, wherein the main circular portions of each lock aperture is offset with respect to the corresponding conductor aperture so a conductor extending through the respective conductor aperture and lock apertures is gripped between the walls of a lateral extension of each main circular portion and the conductor aperture. Preferably, lock means are provided to retain the lock member in said retention position to thereby maintain the grip upon the conductors. Conveniently, the lock means is activated in response to the movement of the lock member to the retention position.

Conveniently, the lock member may be in the form of a plate slidably supported in guides provided in or adjacent the terminal block and arranged to move in a direction at right angles to the direction of the conductor apertures, with the plate in face-to-face contact with an internal surface of the terminal block through which the conductor apertures pass. The lock member and the terminal block may be provided with respective elements which automatically engage, in a snap action, when the lock member is moved to the retention position, thereby preventing accidental or undesirable movement of the lock member in the reverse direction and maintaining the grip on the respective conductors.

Preferably, each respective conductor aperture has a portion off-set with respect to the corresponding terminal cavity by an amount so that when the lock member is in the retention position, the conductor in each respective conductor aperture is located in the off-set portion which is then to substantially align with the respective terminal cavity.

The invention will be more readily understood from the following description of one practical arrangement of the multi-conductor terminal assembly as illustrated in the accompanying drawings in which.

The terminal assembly as shown in FIGS. 1, 2, 3 and 7 comprises a terminal block 10 having an end face 11 provided with a plurality of cavities 13 formed therein to releasably receive respective terminal elements. The construction of such cavities and the co-operating terminal elements are well known and shall therefore not be described further herein.

Figure 1:
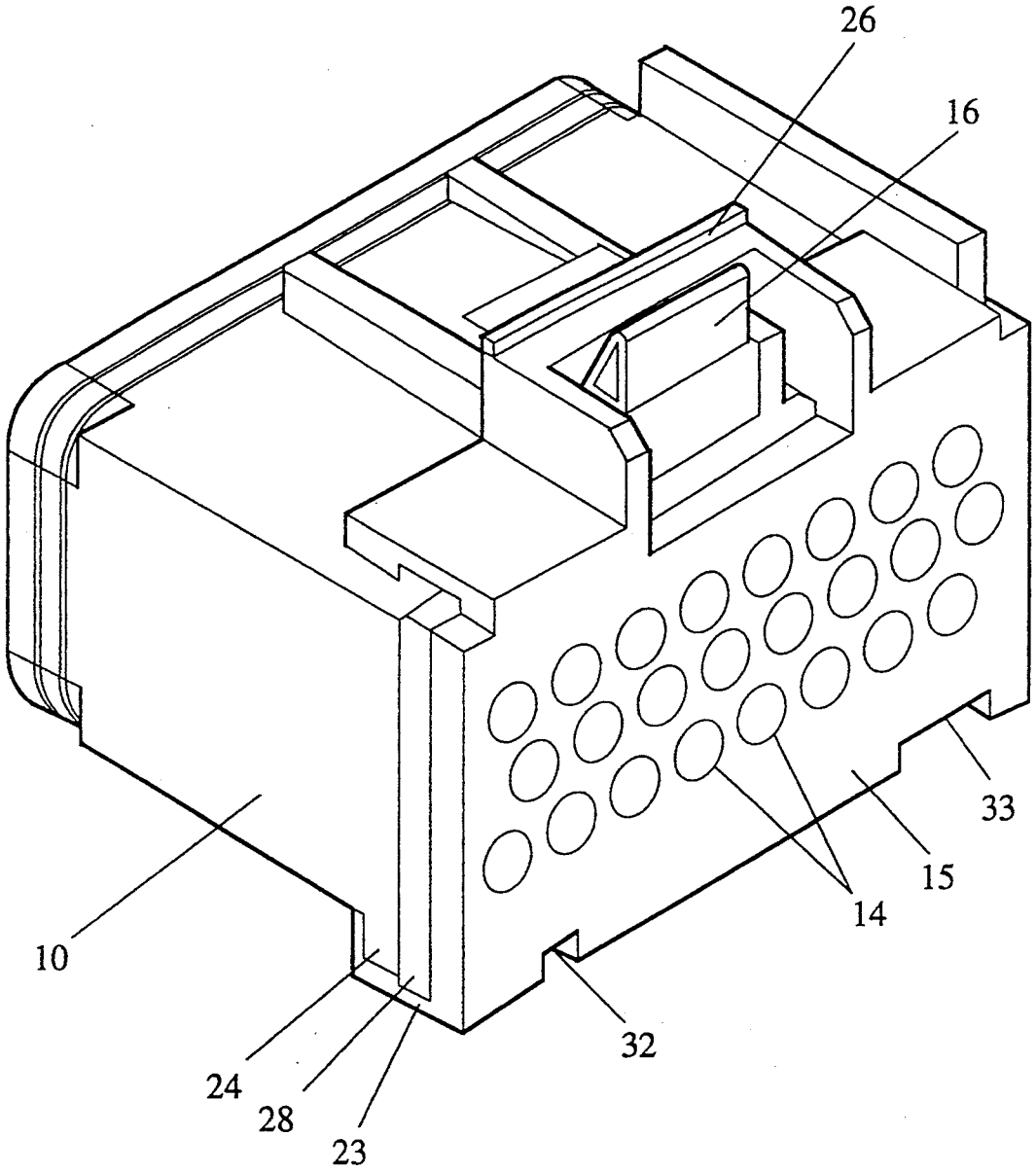
FIG. 1 is a perspective view of the terminal assembly in use.
Figure 2:
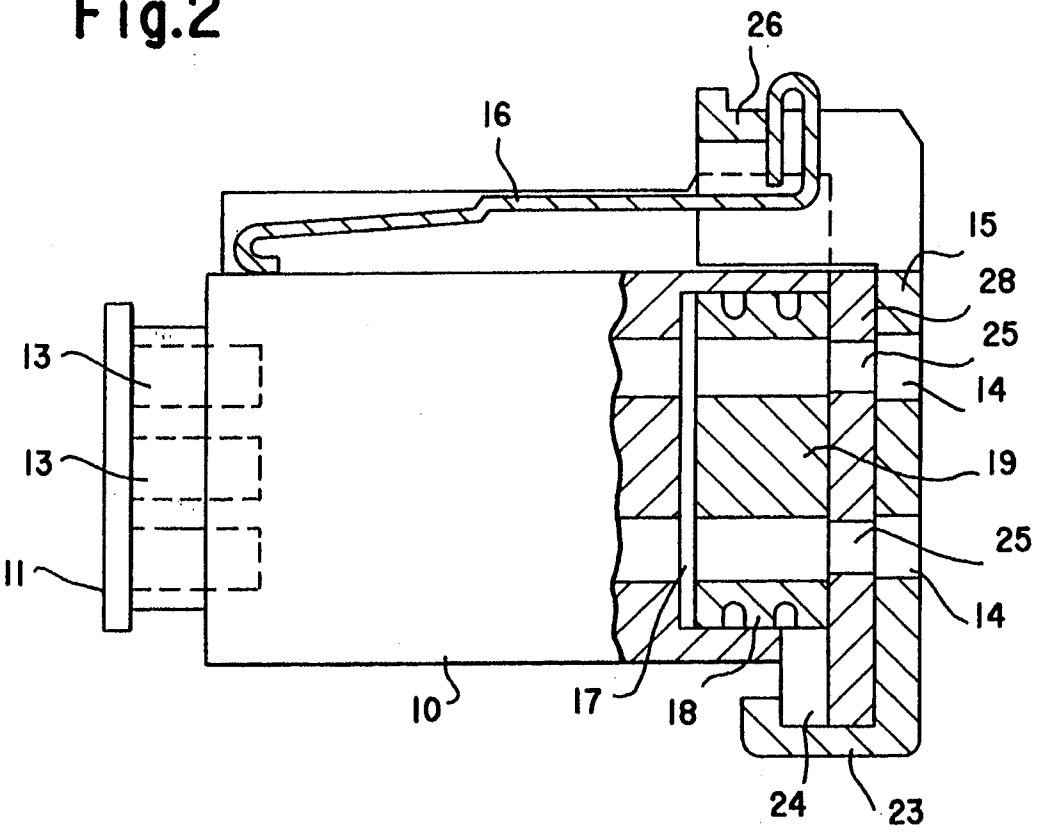
FIG. 2 is a partly sectioned view of the terminal assembly.
Figure 3:
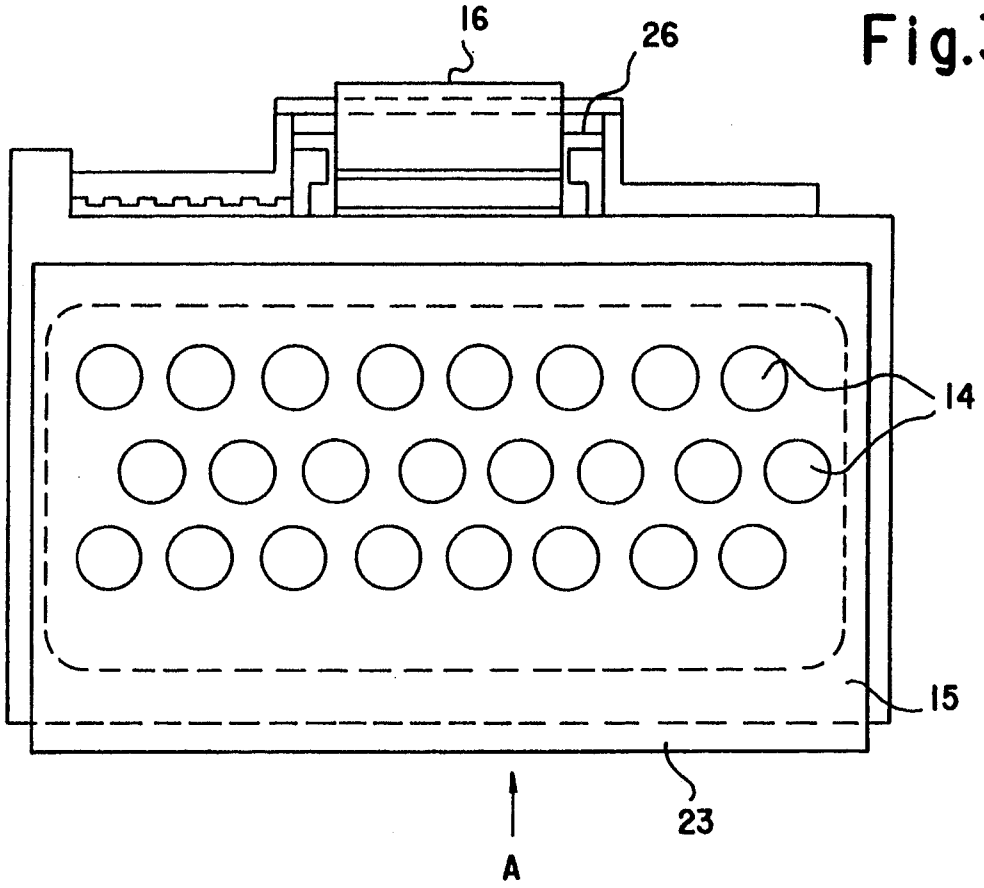
FIG. 3 is a front end view of the terminal assembly.
Figure 4:
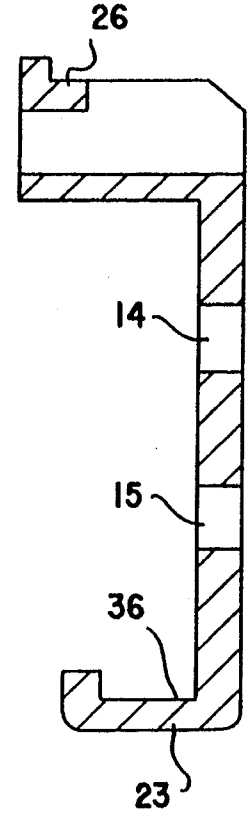
FIG. 4 is a sectional view of an end plate of said terminal assembly.

At the opposite end of the terminal block 10 is a detachable end plate 15, shown in a sectional view in FIG. 4, having a plurality of circular cross-sectional apertures 14 therein in a formation corresponding to that of the cavities 13 extending from the opposite end of the terminal block 10, so that when the end plate 15 is assembled to the terminal block 10, and locked in position by the clip 16, the apertures 14 are in a slightly offset position with respect to the cavities 13 in the terminal block 10. This is most clearly shown in FIG. 8.

Located within the body of the terminal block 10 between the inner face 17 of the body and the end plate 15 is a seal member 19 made of a resiliently deformable material such as silicone rubber. The seal member 19 has seal ridges 18 around the periphery thereof to engage the complementary internal faces of the body of the terminal block 10 to form a substantial seal therebetween against the entry of moisture and/or dust particles. When the seal member 18 is in position within the body of the terminal block 10, the outer face thereof is substantially flush with the end of the body of the terminal block 10. The end plate 15 has a shoulder 23 along one edge thereof to co-operate with the ridge 24 on the body of terminal block 10. On the opposite edge of the end plate 15 is a catch 26 configured to co-operate in a snap action with the clip 16 secured to the terminal block 10.

Figure 8:
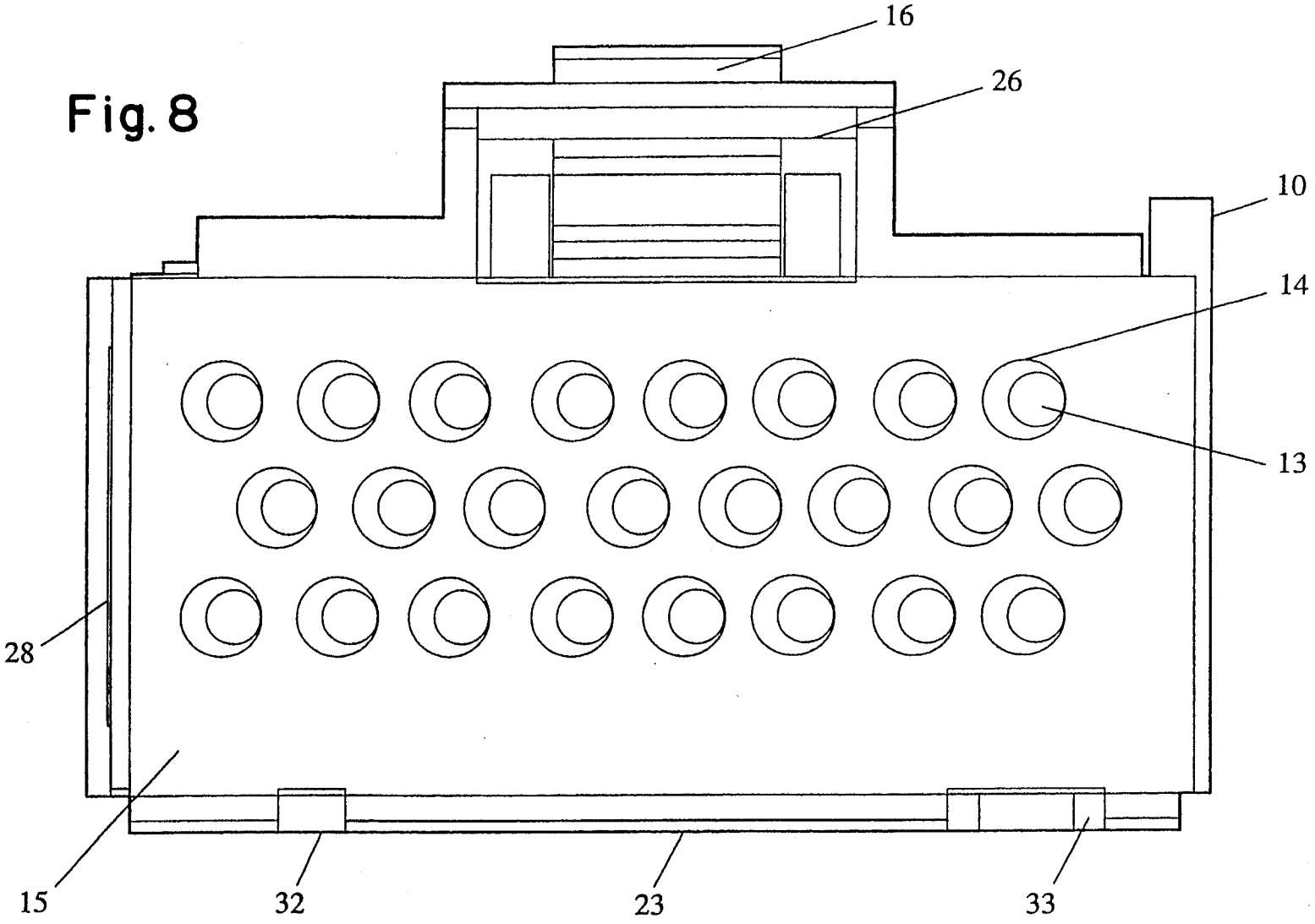
FIG. 8 is a front end view of the terminal assembly with the locking plate in a receiving position.

Located between the end face of the body of the terminal block 10, and the opposing face of the end plate 15, is a locking plate 28 having an array of locking plate apertures 25 therein corresponding to the array of apertures 14 in the end plate 15. Each locking plate aperture 25 in the locking plate 28 as shown in detail in FIG. 6 has a circular main portion 25A and a lateral extension 25B of a width less than the diameter of the locking plate aperture 25. The extension 25*a* of each locking plate aperture 25 in each row may, as shown in both FIGS. 6 and 9, extend to the adjacent aperture 25 in the same row. The continuation of the lateral extension 25B to the adjacent aperture is not essential but does assist in the clamping of the respective conductors in the respective apertures 14 as described further below. The circular main portions of the locking plate apertures 25 are of the same nominal diameter as the apertures 14, and are arranged in the same multi-row formation and spacing as the rows of the apertures 14. This arrangement enables the circular main portion 25A to be located in alignment with the corresponding aperture 14 in the end plate 15 as shown in FIG. 8 so respective conductors with or without terminals connected thereto can freely pass therethrough.

Figure 6:
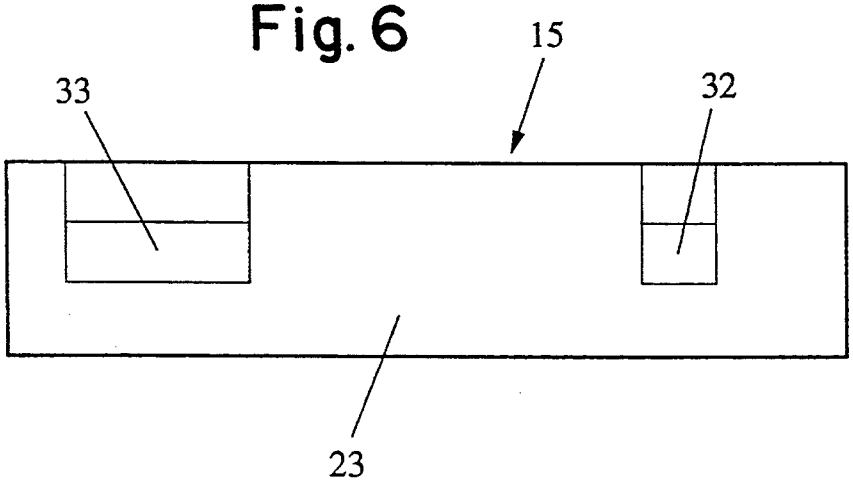
FIG. 6 is a detailed view of a locking plate of said terminal assembly.
Figure 7:
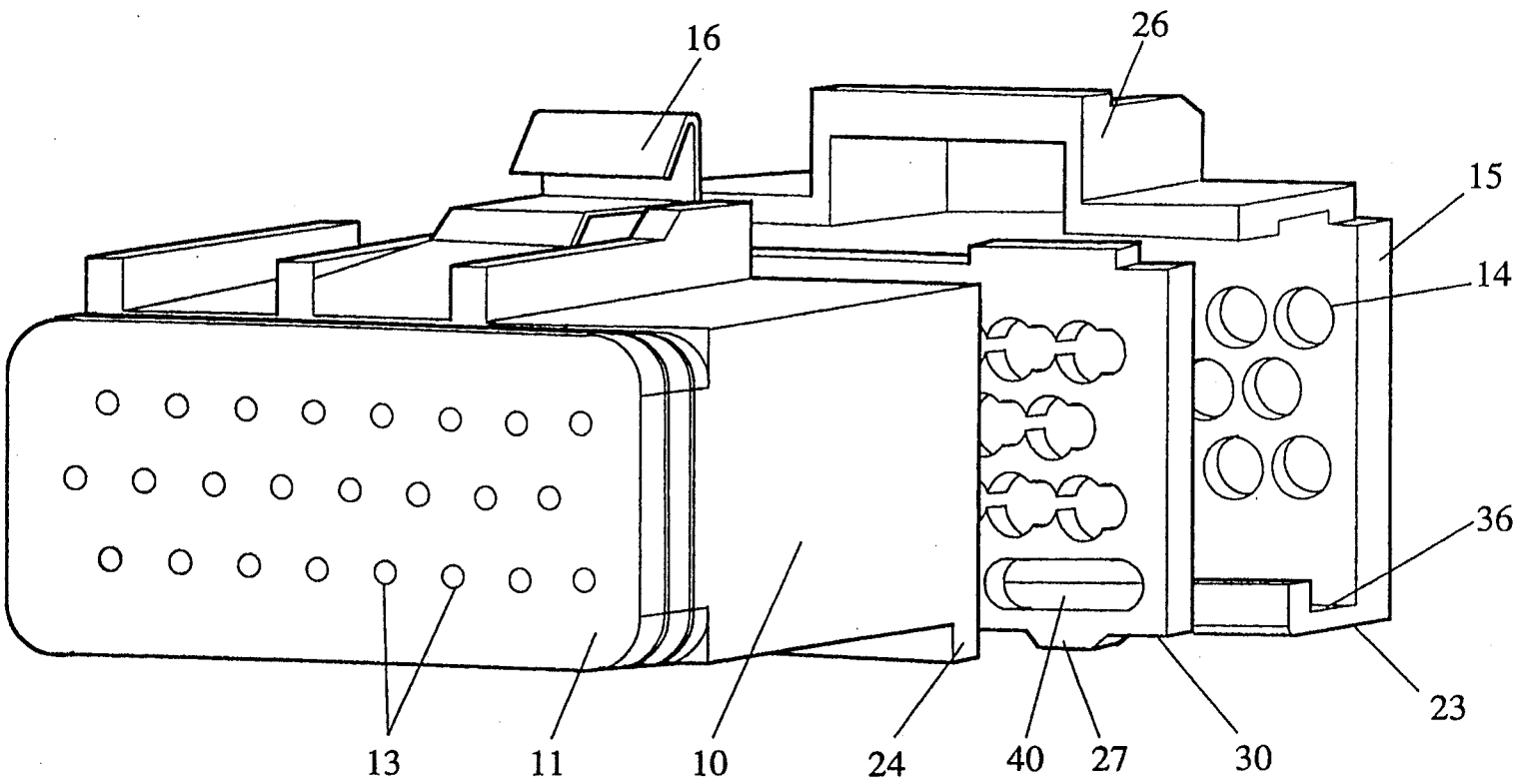
FIG. 7 is an exploded view in rear perspective of the terminal assembly.

The locking plate 28 is mounted in groove 36 within end plate 15 to have a close sliding fit between the inner face of the end plate 15 and the opposing end face of the terminal block 10. The locking plate 28 is provided with respective tongues 29 and 31 along the edge 30 spaced in the direction of movement of the locking plate 28 relative to the end plate 15. The end plate 15 is provided with corresponding slots 32 and 33 in the shoulder 23 thereof as shown in FIG. 6. The slot 33, which receives the tongue 31, is of a length to permit the movement of the locking plate 28 relative to the end plate 15 from a position where the apertures 14 and circular portions 25A are aligned to receive the conductor to the conductor grip or retention position illustrated in FIG. 9 wherein the walls of the lateral extension 25B of aperture 25 engage or grip the conductor or beyond the retention position.

The tongue 29 and slot 32 are dimensioned and located so that when the locking plate 28 is in the retention position to lock or grip the conductor, the tongue 29 will extend into the slot 32 and will prevent any substantial movement of locking plate 28, thus maintaining the conductor locked to the terminal block 10 in substantial alignment with the cavity 13, that is to say, the terminal element, to limit transmission of vibration along the conductor to the terminal element.

The slot 40 in the locking plate 28 is included to provide increased flexibility in the area of the tongue 29, so that the tongue 29 can move upwardly to permit it to ride along the groove 36 within the shoulder 23 of the end plate 15 and snap into the slot 32.

Figure 5:
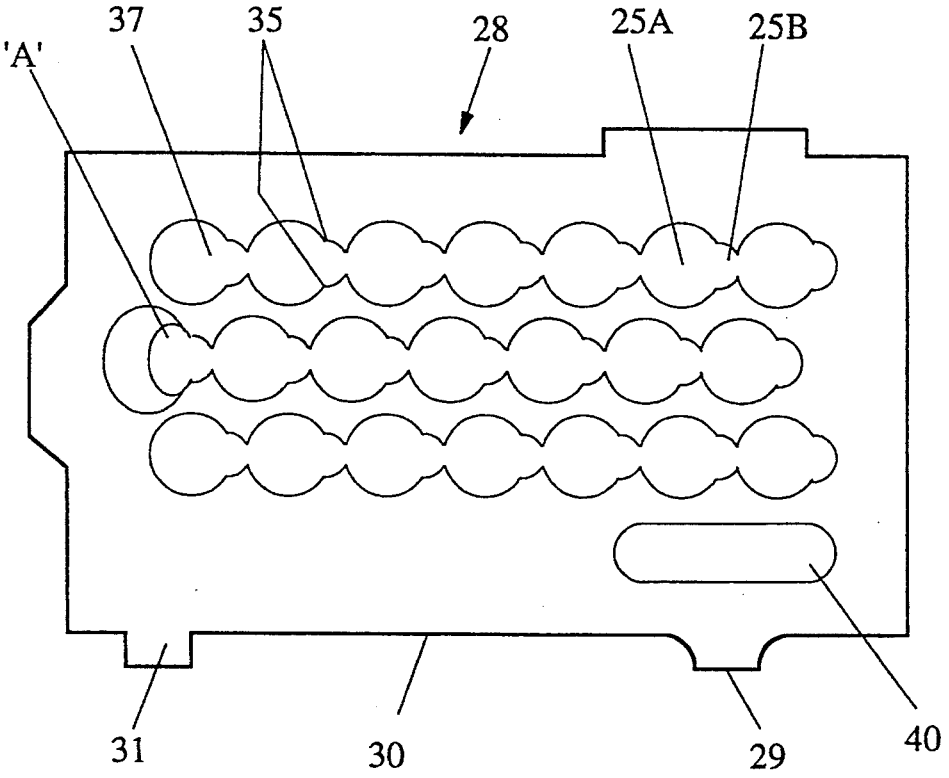
FIG. 5 is a bottom view of the end plate in the direction A in FIG. 3.

As can be seen in FIG. 5, the lateral extension 25B of each aperture 25 extends from one sector of circular portion 25A and is defined by two arcuate sections 35, defining a portion of a circle having an axis along the same longitudinal line as the common axis of the adjacent apertures 25 in the same row. The common centre of the arcuate sections 35, described is located so that at the left hand end, the arcuate section 35, intersect the circular portions 25A to provide a wider opening 37, than where the arcuate sections 35 intersect the adjacent aperture 25 to the right thereof. It is also to be noted that the diameter of the circle, of which the arcuate sections 35 form part, is not greater than, and is preferably slightly less than, the diameter of the conductor (including any insulation covering thereon) which in use extends through the end plate 15 and locking plate 28.

Figure 9:
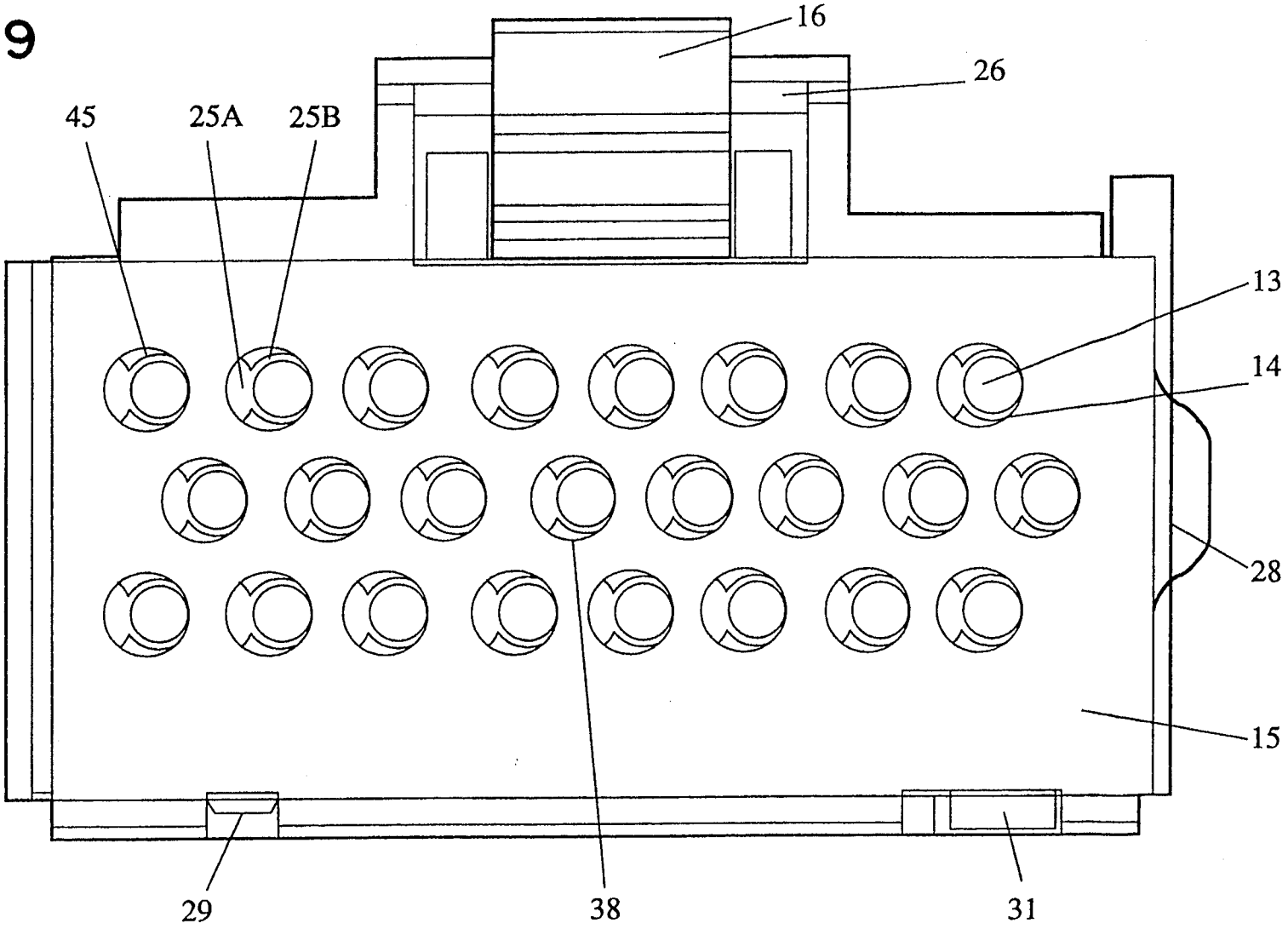
FIG. 9 is a front end view of the terminal assembly with the locking plate in a retention position.

It can thus be seen that with a conductor extending through the aligned apertures 14 and circular portions 25A, the conductor will have a degree of freedom of movement within the apertures 14 and circular portions 25A. However, after the locking plate 28 has been moved to the right as seen in FIG. 9 to the retention position, the conductor is substantially located in a fixed position between the two arcuate sections 35 of the extension 25B as indicated in FIG. 9 and indicated at A in FIG. 6. The conductor is then firmly held by the arcuate sections 35 and the portion 38 of the aperture 14 in the end plate 15. The portion of the conductor subject to the clamping can be the bore conductor or the insulated part thereof.

As a result, the conductor is clamped about substantially the complete circumference thereof by the combined action of three arcuate surfaces provided by the surfaces 35 and portion of the surface 38 of the aperture 14. Each conductor is thus subject to substantially each clamping actions and forces.

It is further to be noted that, when the locking plate 28 is at the left hand end of the extent of its movement as seen in FIG. 8, the circular portions 25A in the locking plate 28 have the axis thereof aligned with respect to the axis of the aperture 14 in the end plate 15. However, when the locking plate 28 has been moved to its full extent to the right as shown in FIG. 9, the axis of the circle of which the arcuate sections 35 form part is now in line with the axis of the corresponding cavities 13 in the terminal block. Hence, each conductor is anchored such that it is axially aligned with the corresponding axis of the cavities 13.

It is appreciated that different arrangements of said terminal block with said locking plate could be provided. For example, the terminal block could be arranged with the locking plate located substantially centrally therein and integral therewith such that transverse movement thereof facilitates the individual clamping of each conductor desired to be connected to the terminal block.

What is claimed is:

1. A multi-conductor terminal assembly comprising:

a terminal block having at least two terminal cavities at one face of the block to receive respective terminal elements;

at least two conductor apertures in another face of the terminal block arranged to permit respective conductors passing therethrough to be connected to a terminal element in, or to be located in, a respective terminal cavity; and an anchor mechanism operable to anchor each conductor to the terminal block said anchor mechanism including:

a locking element selectively movable between a first position permitting passage of the conductors through the conductor apertures, and a second position locking each of said conductors relative to the terminal block, the respective conductors being substantially in alignment with said respective terminal cavities when said locking element is in said second position, said locking element remaining in slidable contact during the locking operation with a substantial portion of said another face in which the conductor apertures are located, said locking element comprising a lock member having at least two lock apertures therein corresponding in number and formation to the conductor apertures in the terminal block, said lock member being in the form of a plate slidably supported in the terminal block to move in a direction at right angles to the direction of the conductor apertures with the plate in face-to-face contact with an internal surface of the terminal block through which the conductor apertures pass.

2. The assembly as claimed in claim 1 characterised in that the lock member and terminal block are provided with respective elements which automatically engage when the lock member is moved to the retention position thereby preventing undesirable movement of the lock member in the reverse direction and maintaining the grip on the respective conductors.

3. The assembly as claimed in claim 1 characterised in that said anchor mechanism is mounted at one end of the terminal block.

4. The assembly as claimed in claim 1 characterised in that said anchor mechanism is mounted substantially centrally of the terminal block.

5. The assembly as claimed in claim 1 wherein in said second position each conductor is clamped about substantially the complete circumference thereof.

6. The assembly as claimed in claim 1 characterised in that said lock member is mounted in the terminal block for movement relative thereto in a direction inclined to the conductors extending through the conductor apertures.

7. The assembly as claimed in claim 6 characterised in that said lock member is mounted in the terminal block for movement relative thereto in the transverse direction to the conductors extending through the conductor apertures.

8. The assembly as claimed in claim 1 characterised in that said lock member is selectively movable between a receiver position wherein lock apertures substantially aligned with the conductor apertures such as to enable said conductors to be passed through both sets of apertures and a retention position wherein each lock aperture is offset with respect to the corresponding conductor aperture so a conductor extending through the respective conductor aperture and lock apertures is gripped between the respective aperture walls.

9. The assembly as claimed in claim 8, characterized in that the axis of each respective lock aperture is off-set with respect to the corresponding terminal cavity by an amount so that when the lock member in the retention position, the conductor in each respective lock aperture is displaced to such an extent as to substantially align with the respective terminal cavity.

10. The assembly as claimed in claim 8 characterised in that retention means are provided to retain the lock member in said retention position to thereby maintain the grip upon the conductors.

11. The assembly as claimed in claim 10 characterised in that the retention means is activated in response to the movement of the lock member to the retention position.

12. The assembly as claimed in claim 11 characterised in that said lock apertures comprise a circular main portion extended at one sector thereof by a lateral extension, defined by the arcuate sections forming a portion of a circle having an axis along the same longitudinal line as the common axis of the circular main portions and of width less than the diameter of said circular main portions.

13. The assembly as claimed in claim 12 wherein adjacent lock apertures are joined together by said lateral extension.

* * * * *